US005401942A

United States Patent [19]

Buerger

[11] Patent Number: 5,401,942

[45] Date of Patent: Mar. 28, 1995

[54] DEVICE FOR CALCULATING NO DECOMPRESSION DIVE TIMES

[76] Inventor: Thomas J. Buerger, 2902 Squire La., Mobile, Ala. 36695

[21] Appl. No.: 141,358

[22] Filed: Oct. 28, 1993

Related U.S. Application Data

[63] Continuation of Ser. No. 843,394, Feb. 28, 1992, abandoned.

[51] Int. Cl.[6] ..... G06G 1/02; G06C 27/00

[52] U.S. Cl. ..... 235/70 R; 235/70 A; 235/78 R

[58] Field of Search ..... 235/70 A, 71 R, 78 R, 235/79, 79.5, 84, 86, 87 R, 88 R

[56] References Cited

U.S. PATENT DOCUMENTS

| | | | |
|---|---|---|---|
| 1,209,878 | 12/1916 | Oliver | 235/79 |
| 3,058,653 | 10/1962 | Des Granges | 235/88 R |
| 3,123,291 | 3/1964 | Madry | 235/87 R |
| 3,578,241 | 5/1971 | Wombough | 235/78 R |
| 4,369,358 | 1/1983 | Adams | 235/87 R |

OTHER PUBLICATIONS

Mosby Lifeline, 1979, p. 269, "Jeppesen" (no month).

*Primary Examiner*—Michael L. Gellner
*Assistant Examiner*—Eddie C. Lee
*Attorney, Agent, or Firm*—Gregory M. Friedlander

[57] ABSTRACT

A new device including a new arrangement of dive tables is disclosed for planning non-decompression dives. The invention utilizes two separate scales, movable relative to one another. The first scale shows the pressure group scale, the bottom time or residual nitrogen scale and surface intervals aligned by relationship to pressure group. The second scale shows depth scales, repetitive dive group, pressure group, and no decompression time limits scale. Windows in the second scale allow the observation of pressure group scales and corresponding bottom time on alignment of bottom time from scale one with depth from the second scale.

10 Claims, 3 Drawing Sheets

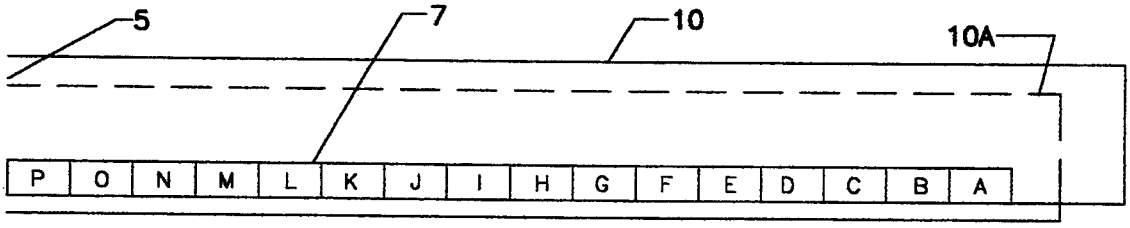

FIGURE 2

| | | | | | | | | | | | | | | | |
|---|---|---|---|---|---|---|---|---|---|---|---|---|---|---|---|
| 0:32<br>0:35 | 0:36<br>0:40 | 0:41<br>0:44 | 0:45<br>0:49 | 0:50<br>0:54 | 0:55<br>0:59 | 1:00<br>1:05 | 1:06<br>1:11 | 1:12<br>1:17 | 1:18<br>1:24 | 1:25<br>1:31 | 1:32<br>1:40 | 1:41<br>1:49 | 1:50<br>2:11 | 2:12<br>2:59 | 3:00<br>6:00 |
| 0:30<br>0:33 | 0:34<br>0:37 | 0:38<br>0:41 | 0:42<br>0:46 | 0:47<br>0:51 | 0:52<br>0:56 | 0:57<br>1:02 | 1:03<br>1:08 | 1:09<br>1:14 | 1:15<br>1:21 | 1:22<br>1:29 | 1:30<br>1:37 | 1:38<br>1:46 | 1:47<br>2:08 | 2:09<br>2:56 | 2:57<br>5:57 |
| 0:27<br>0:30 | 0:31<br>0:34 | 0:35<br>0:39 | 0:40<br>0:43 | 0:44<br>0:48 | 0:49<br>0:53 | 0:54<br>0:59 | 1:00<br>1:05 | 1:06<br>1:11 | 1:12<br>1:18 | 1:19<br>1:26 | 1:27<br>1:34 | 1:35<br>1:43 | 1:44<br>2:05 | 2:06<br>2:53 | 2:54<br>5:54 |
| 0:24<br>0:27 | 0:28<br>0:31 | 0:32<br>0:36 | 0:37<br>0:40 | 0:41<br>0:45 | 0:46<br>0:50 | 0:51<br>0:56 | 0:57<br>1:02 | 1:03<br>1:08 | 1:09<br>1:15 | 1:16<br>1:23 | 1:24<br>1:31 | 1:32<br>1:40 | 1:41<br>2:02 | 2:03<br>2:50 | 2:51<br>5:51 |
| 0:21<br>0:24 | 0:25<br>0:28 | 0:29<br>0:33 | 0:34<br>0:37 | 0:38<br>0:42 | 0:43<br>0:47 | 0:48<br>0:53 | 0:54<br>0:59 | 1:00<br>1:05 | 1:06<br>1:12 | 1:13<br>1:20 | 1:21<br>1:28 | 1:29<br>1:37 | 1:38<br>1:59 | 2:00<br>2:47 | 2:48<br>5:48 |
| 0:18<br>0:21 | 0:22<br>0:25 | 0:26<br>0:29 | 0:30<br>0:34 | 0:35<br>0:39 | 0:40<br>0:44 | 0:45<br>0:50 | 0:51<br>0:56 | 0:57<br>1:02 | 1:03<br>1:09 | 1:10<br>1:17 | 1:18<br>1:25 | 1:26<br>1:34 | 1:35<br>1:56 | 1:57<br>2:44 | 2:45<br>5:45 |
| 0:14<br>0:17 | 0:18<br>0:22 | 0:23<br>0:26 | 0:27<br>0:31 | 0:32<br>0:36 | 0:37<br>0:41 | 0:42<br>0:47 | 0:48<br>0:53 | 0:54<br>0:59 | 1:00<br>1:06 | 1:07<br>1:13 | 1:14<br>1:22 | 1:23<br>1:31 | 1:32<br>1:53 | 1:54<br>2:41 | 2:42<br>5:42 |
| 0:11<br>0:14 | 0:15<br>0:18 | 0:19<br>0:23 | 0:24<br>0:27 | 0:28<br>0:32 | 0:33<br>0:38 | 0:39<br>0:43 | 0:44<br>0:49 | 0:50<br>0:56 | 0:57<br>1:03 | 1:04<br>1:10 | 1:11<br>1:18 | 1:19<br>1:27 | 1:28<br>1:49 | 1:50<br>2:38 | 2:39<br>5:39 |
| 0:08<br>0:11 | 0:12<br>0:15 | 0:16<br>0:19 | 0:20<br>0:24 | 0:25<br>0:29 | 0:30<br>0:34 | 0:35<br>0:40 | 0:41<br>0:46 | 0:47<br>0:52 | 0:53<br>0:59 | 1:00<br>1:07 | 1:08<br>1:15 | 1:16<br>1:24 | 1:25<br>1:46 | 1:47<br>2:34 | 2:35<br>5:35 |
| 0:04<br>0:07 | 0:08<br>0:11 | 0:12<br>0:16 | 0:17<br>0:20 | 0:21<br>0:25 | 0:26<br>0:30 | 0:31<br>0:36 | 0:37<br>0:42 | 0:43<br>0:48 | 0:49<br>0:55 | 0:56<br>1:03 | 1:04<br>1:11 | 1:12<br>1:20 | 1:21<br>1:42 | 1:43<br>2:30 | 2:31<br>5:31 |
| 0:00<br>0:03 | 0:04<br>0:07 | 0:08<br>0:12 | 0:13<br>0:16 | 0:17<br>0:21 | 0:22<br>0:27 | 0:28<br>0:32 | 0:33<br>0:38 | 0:39<br>0:45 | 0:46<br>0:51 | 0:52<br>0:59 | 1:00<br>1:07 | 1:08<br>1:16 | 1:17<br>1:38 | 1:39<br>2:27 | 2:28<br>5:28 |
| | 0:00<br>0:03 | 0:04<br>0:08 | 0:09<br>0:12 | 0:13<br>0:17 | 0:18<br>0:23 | 0:24<br>0:28 | 0:29<br>0:34 | 0:35<br>0:41 | 0:42<br>0:57 | 0:48<br>0:55 | 0:56<br>1:03 | 1:04<br>1:12 | 1:13<br>1:34 | 1:35<br>2:23 | 2:24<br>5:24 |
| | | 0:00<br>0:03 | 0:04<br>0:08 | 0:09<br>0:13 | 0:14<br>0:18 | 0:19<br>0:24 | 0:25<br>0:30 | 0:31<br>0:36 | 0:37<br>0:43 | 0:44<br>0:51 | 0:52<br>0:59 | 1:00<br>1:08 | 1:09<br>1:30 | 1:31<br>2:18 | 2:19<br>5:19 |
| | | | 0:00<br>0:04 | 0:05<br>0:09 | 0:10<br>0:14 | 0:15<br>0:19 | 0:20<br>0:25 | 0:26<br>0:32 | 0:33<br>0:39 | 0:40<br>0:46 | 0:47<br>0:55 | 0:56<br>1:04 | 1:05<br>1:25 | 1:26<br>2:14 | 2:15<br>5:15 |
| | | | | 0:00<br>0:04 | 0:05<br>0:09 | 0:10<br>0:15 | 0:16<br>0:21 | 0:22<br>0:27 | 0:28<br>0:34 | 0:35<br>0:42 | 0:43<br>0:50 | 0:51<br>0:59 | 1:00<br>1:21 | 1:22<br>2:09 | 2:10<br>5:10 |
| | | | | | 0:00<br>0:04 | 0:05<br>0:10 | 0:11<br>0:16 | 0:17<br>0:22 | 0:23<br>0:29 | 0:30<br>0:37 | 0:38<br>0:45 | 0:46<br>0:54 | 0:55<br>1:16 | 1:17<br>2:04 | 2:05<br>5:05 |
| | | | | | | 0:00<br>0:05 | 0:06<br>0:11 | 0:12<br>0:17 | 0:18<br>0:24 | 0:25<br>0:31 | 0:32<br>0:40 | 0:41<br>0:49 | 0:50<br>1:11 | 1:12<br>1:59 | 2:00<br>5:00 |
| | | | | | | | 0:00<br>0:05 | 0:06<br>0:11 | 0:12<br>0:18 | 0:19<br>0:26 | 0:27<br>0:34 | 0:35<br>0:43 | 0:44<br>1:05 | 1:06<br>1:53 | 1:54<br>4:54 |
| | | | | | | | | 0:00<br>0:05 | 0:06<br>0:12 | 0:13<br>0:20 | 0:21<br>0:28 | 0:29<br>0:37 | 0:38<br>0:59 | 1:00<br>1:47 | 1:48<br>4:48 |
| | | | | | | | | | 0:00<br>0:06 | 0:07<br>0:13 | 0:14<br>0:22 | 0:23<br>0:31 | 0:32<br>0:53 | 0:54<br>1:41 | 1:42<br>4:42 |
| | | | | | | | | | | 0:00<br>0:07 | 0:08<br>0:15 | 0:16<br>0:24 | 0:25<br>0:46 | 0:47<br>1:34 | 1:35<br>4:35 |
| | | | | | | | | | | | 0:00<br>0:07 | 0:08<br>0:16 | 0:17<br>0:38 | 0:39<br>1:27 | 1:28<br>4:28 |
| | | | | | | | | | | | | 0:00<br>0:08 | 0:09<br>0:30 | 0:31<br>1:18 | 1:19<br>4:19 |
| | | | | | | | | | | | | | 0:00<br>0:21 | 0:22<br>1:09 | 1:10<br>4:10 |
| | | | | | | | | | | | | | | 0:00<br>0:47 | 0:48<br>3:48 |
| | | | | | | | | | | | | | | | 0:00<br>3:00 |

FIGURE 1

| | | | | | | | | | | | | | | |
|---|---|---|---|---|---|---|---|---|---|---|---|---|---|---|
| 0:36<br>0:40 | 0:41<br>0:44 | 0:45<br>0:49 | 0:50<br>0:54 | 0:55<br>0:59 | 1:00<br>1:05 | 1:06<br>1:11 | 1:12<br>1:17 | 1:18<br>1:24 | 1:25<br>1:31 | 1:32<br>1:40 | 1:41<br>1:49 | 1:50<br>2:11 | 2:12<br>2:59 | 3:00<br>6:00 |
| 0:34<br>0:37 | 0:38<br>0:41 | 0:42<br>0:46 | 0:47<br>0:51 | 0:52<br>0:56 | 0:57<br>1:02 | 1:03<br>1:08 | 1:09<br>1:14 | 1:15<br>1:21 | 1:22<br>1:29 | 1:30<br>1:37 | 1:38<br>1:46 | 1:47<br>2:08 | 2:09<br>2:56 | 2:57<br>5:57 |
| 0:31<br>0:34 | 0:35<br>0:39 | 0:40<br>0:43 | 0:44<br>0:48 | 0:49<br>0:53 | 0:54<br>0:59 | 1:00<br>1:05 | 1:06<br>1:11 | 1:12<br>1:18 | 1:19<br>1:26 | 1:27<br>1:34 | 1:35<br>1:43 | 1:44<br>2:05 | 2:06<br>2:53 | 2:54<br>5:54 |
| 0:28<br>0:31 | 0:32<br>0:36 | 0:37<br>0:40 | 0:41<br>0:45 | 0:46<br>0:50 | 0:51<br>0:56 | 0:57<br>1:02 | 1:03<br>1:08 | 1:09<br>1:15 | 1:16<br>1:23 | 1:24<br>1:31 | 1:32<br>1:40 | 1:41<br>2:02 | 2:03<br>2:50 | 2:51<br>5:51 |
| 0:25<br>0:28 | 0:29<br>0:33 | 0:34<br>0:37 | 0:38<br>0:42 | 0:43<br>0:47 | 0:48<br>0:53 | 0:54<br>0:59 | 1:00<br>1:05 | 1:06<br>1:12 | 1:13<br>1:20 | 1:21<br>1:28 | 1:29<br>1:37 | 1:38<br>1:59 | 2:00<br>2:47 | 2:48<br>5:48 |
| 0:22<br>0:25 | 0:26<br>0:29 | 0:30<br>0:34 | 0:35<br>0:39 | 0:40<br>0:44 | 0:45<br>0:50 | 0:51<br>0:56 | 0:57<br>1:02 | 1:03<br>1:09 | 1:10<br>1:17 | 1:18<br>1:25 | 1:26<br>1:34 | 1:35<br>1:56 | 1:57<br>2:44 | 2:45<br>5:45 |
| 0:18<br>0:22 | 0:23<br>0:26 | 0:27<br>0:31 | 0:32<br>0:36 | 0:37<br>0:41 | 0:42<br>0:47 | 0:48<br>0:53 | 0:54<br>0:59 | 1:00<br>1:06 | 1:07<br>1:13 | 1:14<br>1:22 | 1:23<br>1:31 | 1:32<br>1:53 | 1:54<br>2:41 | 2:42<br>5:42 |
| 0:15<br>0:18 | 0:19<br>0:23 | 0:24<br>0:27 | 0:28<br>0:32 | 0:33<br>0:38 | 0:39<br>0:43 | 0:44<br>0:49 | 0:50<br>0:56 | 0:57<br>1:03 | 1:04<br>1:10 | 1:11<br>1:18 | 1:19<br>1:27 | 1:28<br>1:49 | 1:50<br>2:38 | 2:39<br>5:39 |
| 0:12<br>0:15 | 0:16<br>0:19 | 0:20<br>0:24 | 0:25<br>0:29 | 0:30<br>0:34 | 0:35<br>0:40 | 0:41<br>0:46 | 0:47<br>0:52 | 0:53<br>0:59 | 1:00<br>1:07 | 1:08<br>1:15 | 1:16<br>1:24 | 1:25<br>1:46 | 1:47<br>2:34 | 2:35<br>5:35 |
| 0:08<br>0:11 | 0:12<br>0:16 | 0:17<br>0:20 | 0:21<br>0:25 | 0:26<br>0:30 | 0:31<br>0:36 | 0:37<br>0:42 | 0:43<br>0:48 | 0:49<br>0:55 | 0:56<br>1:03 | 1:04<br>1:11 | 1:12<br>1:20 | 1:21<br>1:42 | 1:43<br>2:30 | 2:31<br>5:31 |
| 0:04<br>0:07 | 0:08<br>0:12 | 0:13<br>0:16 | 0:17<br>0:21 | 0:22<br>0:27 | 0:28<br>0:32 | 0:33<br>0:38 | 0:39<br>0:45 | 0:46<br>0:51 | 0:52<br>0:59 | 1:00<br>1:07 | 1:08<br>1:16 | 1:17<br>1:38 | 1:39<br>2:27 | 2:28<br>5:28 |
| 0:00<br>0:03 | 0:04<br>0:08 | 0:09<br>0:12 | 0:13<br>0:17 | 0:18<br>0:23 | 0:24<br>0:28 | 0:29<br>0:34 | 0:35<br>0:41 | 0:42<br>0:57 | 0:48<br>0:55 | 0:56<br>1:03 | 1:04<br>1:12 | 1:13<br>1:34 | 1:35<br>2:23 | 2:24<br>5:24 |
| | 0:00<br>0:03 | 0:04<br>0:08 | 0:09<br>0:13 | 0:14<br>0:18 | 0:19<br>0:24 | 0:25<br>0:30 | 0:31<br>0:36 | 0:37<br>0:43 | 0:44<br>0:51 | 0:52<br>0:59 | 1:00<br>1:08 | 1:09<br>1:30 | 1:31<br>2:18 | 2:19<br>5:19 |
| | | 0:00<br>0:04 | 0:05<br>0:09 | 0:10<br>0:14 | 0:15<br>0:19 | 0:20<br>0:25 | 0:26<br>0:32 | 0:33<br>0:39 | 0:40<br>0:46 | 0:47<br>0:55 | 0:56<br>1:04 | 1:05<br>1:25 | 1:26<br>2:14 | 2:15<br>5:15 |
| | | | 0:00<br>0:04 | 0:05<br>0:09 | 0:10<br>0:15 | 0:16<br>0:21 | 0:22<br>0:27 | 0:28<br>0:34 | 0:35<br>0:42 | 0:43<br>0:50 | 0:51<br>0:59 | 1:00<br>1:21 | 1:22<br>2:09 | 2:10<br>5:10 |
| | | | | 0:00<br>0:04 | 0:05<br>0:10 | 0:11<br>0:16 | 0:17<br>0:22 | 0:23<br>0:29 | 0:30<br>0:37 | 0:38<br>0:45 | 0:46<br>0:54 | 0:55<br>1:16 | 1:17<br>2:04 | 2:05<br>5:05 |
| | | | | | 0:00<br>0:05 | 0:06<br>0:11 | 0:12<br>0:17 | 0:18<br>0:24 | 0:25<br>0:31 | 0:32<br>0:40 | 0:41<br>0:49 | 0:50<br>1:11 | 1:12<br>1:59 | 2:00<br>5:00 |
| | | | | | | 0:00<br>0:05 | 0:06<br>0:11 | 0:12<br>0:18 | 0:19<br>0:26 | 0:27<br>0:34 | 0:35<br>0:43 | 0:44<br>1:05 | 1:06<br>1:53 | 1:54<br>4:54 |
| | | | | | | | 0:00<br>0:05 | 0:06<br>0:12 | 0:13<br>0:20 | 0:21<br>0:28 | 0:29<br>0:37 | 0:38<br>0:59 | 1:00<br>1:47 | 1:48<br>4:48 |

10

| | | | | | | | | | | | | | | |
|---|---|---|---|---|---|---|---|---|---|---|---|---|---|---|
| | | | | | | | | | | 0:00<br>0:07 | 0:08<br>0:16 | 0:17<br>0:38 | 0:39<br>1:27 | 1:28<br>4:28 |
| O | N | M | L | K | J | I | H | G | F | E | D | C | B | A |
| | | | | | | | | | | | | 0:00<br>0:21 | 0:22<br>1:09 | 1:10<br>4:10 |
| | | | | | | | | | | | | | 0:00<br>0:47 | 0:48<br>3:48 |
| | | | | | | | | | | | | | | 0:00<br>3:00 |

10A

9

7

FIGURE 3

DEVICE FOR CALCULATING NO DECOMPRESSION DIVE TIMES

This is a continuation of application Ser. No. 07/843,394, filed on Feb. 28, 1992, now abandoned.

PRIOR ART

The invention relates to dive tables.

More particularly the invention relates to mechanical devices designed to simplify reading dive tables, said mechanical devices having separate scales maintained in proper relationship for observation of diving relationships disclosed between the separate scales.

Dive tables and residual nitrogen problems associated with scuba diving are well known in the prior art. The U.S. Navy as well as private organizations prepare various tables for calculating residual nitrogen limits, bottom times, decompression limits and the like. These are well known and well documented.

Different methods for simplifying interpretation of bottom time and repetitive dive information have been developed. These include separate scales on rotating dive computers as either dials, as in U.S. Pat. No. 3,058,653 issued to Granges, or tubes as in U.S. Pat. No. 4,369,358 issued to Adams. None of the prior art utilizes dive tables showing the direct relationship of Bottom time to Residual Nitrogen. Prior tables also fail to disclose a method utilizing only one or two windows thereby complicating the process for calculation. The present invention also simplifies to two steps the calculation for most dives.

Because the present invention is directed to simplifying and improving on methods for mechanically calculating repetitive time for dives, it is important to note that prior methods require as many as six movements. The present invention requires fewer movements to solve non-decompression repetitive dives.

The Granges patent covers compression and non-decompression dives. It utilizes five different windows and two sides. It also requires special charts rotationally aligned which are difficult to read and deviate from standard navy charts. It requires the use of both sides to determine bottom time versus surface interval credit, also referred to as repetitive dive groups. The windows utilized are not lined up making calculations difficult to perform and interpret. Since these calculations are often made on a moving boat, the problems are exacerbated.

The Adams patent discloses the concept of "attaching tables containing the desired information to an inner tube and arranging one or more outer tubes concentrically about the inner tube in a manner whereby the outer tubes are free to rotate about the inner tube. Providing sight windows in the outer tube allows selective reading of the tables." In practice the invention requires multiple side by side tables similar to those shown by the Granges patent. The present invention is a refinement and an improvement over this technology. It reduces the number of motions and tables required for dive table calculations.

It is therefore the object of this invention to provide a mechanically related set of tables for calculating non-decompression dive depths and times.

Another object of the invention is to allow for easy reading of information related to dive statistics.

Another improvement is that the invention allows for an inexpensive and reproducible product and method for using existing dive tables which can be used in a sliding format or in a format using inner and outer tubes rotated relative to one another.

Another improvement is the invention provides a dive table providing for no-decompression dive calculations utilizing a single window or two windows side by side for doing all no decompression dive calculations.

Another object is to provide a calculator with fewer stops and one direction of movement. Additionally, it is improved by restricting the direction the calculator moves in order to prevent error.

These and other improvements will become obvious from the specification and drawings attached hereto.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein:

FIG. 1 is a front view of the slide utilized in the preferred embodiment showing the no decompression limits, depth scale, repetitive dive group scale, pressure group scale, first pressure group window and bottom time window.

FIG. 2 is a front view of the chart for use with the slide shown in FIG. 1 showing the pressure group scale vertically arranged in series with the bottom time/-residual nitrogen scale and surface interval time-tables.

FIG. 3 is a perspective view of the slide in place on the chart.

GENERAL DISCUSSION OF THE INVENTION

Figure 4:
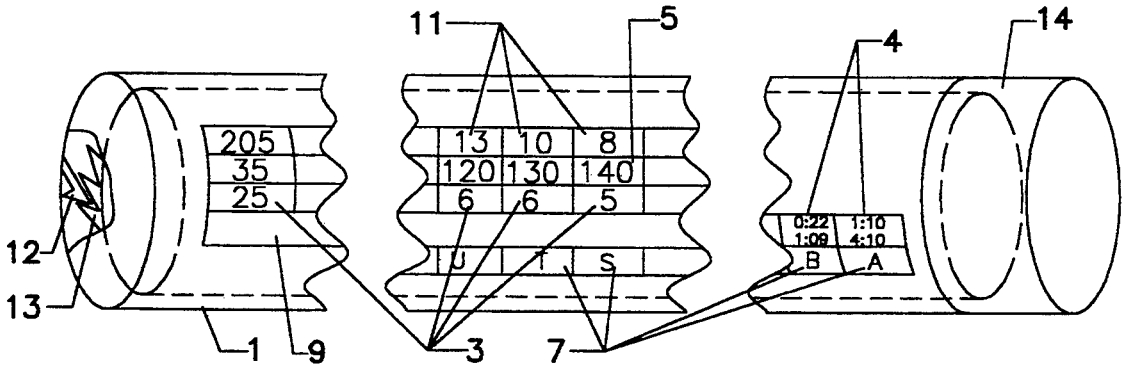
FIG. 4 is sectioned view of an alternately embodiment showing the use of an inner and outer tube arrangement utilizing the scales and window layout shown in FIGS. 1 and 2.

The present invention improves on the prior art providing for a simplified method of aligning charts and chart reading windows.

DETAILED DISCUSSION OF THE PREFERRED EMBODIMENT

To allow for correlation of bottom time to pressure groups and bottom time intervals, chart 1 shows a table of selected pressure groups 2 arranged vertically. Parallel to the pressure groups 2 are corresponding bottom time or residual nitrogen tables 3 calibrated in terms of minutes. In this manner, the pressure group 2 is aligned with bottom times which correspond to the pressure group 2 for various depths which must be obtained separately as will be discussed separately.

Also in alignment with the scales for pressure groups 2 and residual nitrogen tables 3 are surface interval charts 4. All of these charts 2–4 are known in the art from various tables. The inventive concept embodied herein is the arrangement of these charts in order to correlate these utilizing a movable depth scale 5 shown in FIG. 2 mounted on slide 10. Bottom depths for various dives are shown on a lower bottom depth scale 5. Above these depth scales 5 are maximum depth limits 11. This arrangement of depths 5 with maximum limits 11 is known in the art. It is utilized in the present invention in order to assure that the maximum limits are not exceeded. This depth scale when presented on a slide allows the information displayed though the window 8 and slot 9. FIG. 3 shows how the slide 10 fits over the chart 1 so that the two may be read together. As shown in FIG. 1, the slide has a backing 10*a* which attaches to either side of the slide 10 and which serves to hold the slide in position over the chart by fitting over the back of the chart 1.

Only one window need be utilized. In the preferred embodiment, at least two separate windows in alignment shown as a pressure group window 8 and a bottom time slot 9 are provided.

It can be seen that with a single slot 9, all relevant information would be provided in the slot if it extended across all charts on Table 1. As shown in FIG. 2, the alternate embodiment has a single window 9.

For purposes of clarity the example using two windows shown in FIG. 1 is used for the following discussion. The bottom time slot 9 described by the slide 10 is directly below and travels with the depth scales 5. In this way, a particular depth on the depth scale 5 may be aligned with specific bottom time intervals 3. The alignment of pressure groups 2 with the bottom time intervals 3 allows for the pressure group 2 to be determined once the bottom time 3 is aligned with the depth 5.

The relative surface intervals 4 available from these scales are aligned so as to show through slot 9. A second, horizontally disposed pressure group scale 7 is aligned below and calibrated to the surface interval scale 4. Once a pressure group from scale 2 is determined utilizing the alignment of depth 5 and bottom time 3, the surface intervals shown in the far right side of slot 9 are directly above the corresponding pressure group 7. This second pressure group 7 is then usable to determine the maximum bottom time available for the following dive.

Using a sliding scale, 10 as shown in FIG. 2, the scale will always slide towards the bottom of the chart 1 shown in FIG. 1 reducing the likelihood of an error. The surface interval yielded a pressure group on horizontal scale 7. This pressure group 7 is found utilizing the window 8 in vertical scale 2. When the depth is then found on depth scale 5, the bottom time can be calculated by subtracting the maximum time allowable shown above the depth 5 on no decompression limit 11 from the bottom time below the depth 5 as seen through slot 9.

There is an additional improvement shown in FIG. 4. FIG. 4 shows a primary tube 14 having the charts 1 imprinted thereon. As can be seen by reference to FIG. 4, there is an extension 14*a* of primary tube 14 which allows the tube to be turned from the end.

There is a secondary tube 15 which has the information of the slide 10 imprinted thereon positioned around the primary tube 14 so that the information may be read through the single window or slot 9 in secondary tube 15.

A stop 12 may be mounted on the secondary tube 15 and interact with teeth 13 on the primary tube 14. This defines a means for restriction restricting the direction the primary tube 14 moves relative to the secondary tube 15 in order to prevent error by turning the tubes in the wrong direction.

Figure 5:
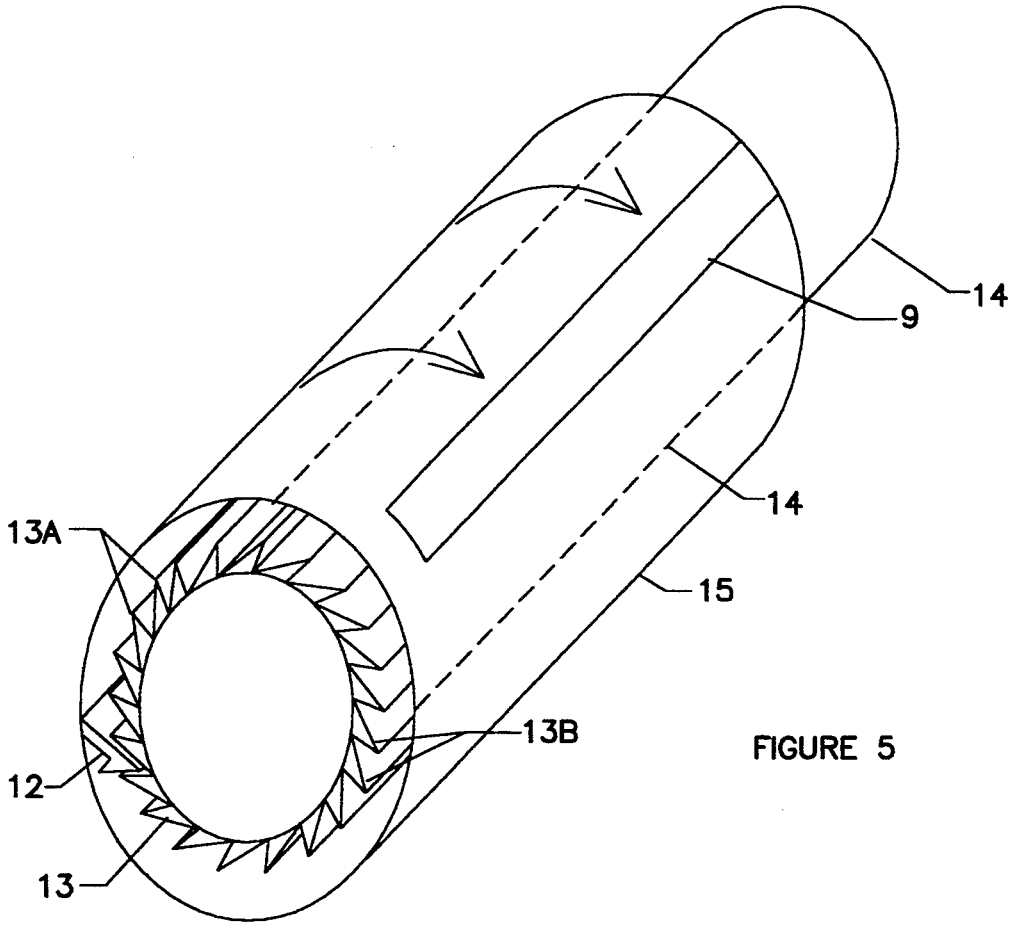
FIG. 5 is a detailed view of the direction restricting mechanism shown in FIG. 4.

Teeth 13 as shown in FIG. 5 define a ramp 13*a* rising in the direction which tube would be turned in ordinary use. The ramp 13*a* ends in a sharp dropping wall 13*b*. The stop 12 is flexible so that it bends as it rises up the ramp 13*a*. When the stop 12 unbends at the wall 13*b* it is restricted from turning back which helps prevent erroneous readings.

EXAMPLES

OPERATION OF THE TUBE

From the portion of the scale 5 on the invention, the user would select the maximum depth he planned to obtain on his first dive, always using the next greater depth if the exact depth is not listed.

EXAMPLE 1

The first dive used as an example will be to 100 feet. On the scale 11 above the maximum depth selected for the first dive, you will find the no decompression limit. It is known that one should always dive within this limit.

By turning the end of the invention, now dial in your bottom time below the maximum depth you have selected. Any dive in the scale 3 under the top three entries of each column of bottom times.

On our first dive we decide to go down for 10 minutes. Your ending pressure group is now displayed in the pressure group window. For a single dive this is all that needs to be done.

EXAMPLE 2

Utilizing the information from example, one hundred feet for 10 minutes, means the user leaves the water as an E diver. When making a repetitive dive you must choose a surface interval to the right of your maximum bottom time.

The user must select the surface interval from those available on the chart and for this example, a one hour surface interval is selected. One hour falls between 0:39–1:27 on the surface interval scale. The letter in FIG. 2 on scale 6 located below the chosen surface interval is the new repetitive dive pressure group.

After a one hour surface interval, the user would re-enter the water as a B diver. Turn the end of the invention until this new pressure group appears in the pressure group window. You are now ready to begin your second dive.

EXAMPLE 3

The letter B should now appear in the pressure group window. Select depth for the second dive. General safety requires that the diver always make the deepest dive first utilizing this method.

The depth is chosen from those available and for this example, the second dive will be to 80 feet. Subtract the residual nitrogen located below the selected depth from the no decompression limit which is located above it. This will give the new, no decompression limit. Again, the user will always dive within this limit to avoid decompression.

Under this example, the new, no decompression limit is 22 minutes. (30−8=22 minutes.) Select a bottom time which will fall within this new no decompression limit; and dial it in, by adding it to the residual nitrogen left over from the first dive.

The second dive will be to 80 feet for 20 minutes. (8+20=28) The ending pressure group will now be displayed in the pressure group window. For a repetitive dive, this is all that needs to be done. You're finished.

80 feet for 20 minutes, means you leave the water as a P diver.

EXAMPLE 4

This utilizes the same information for the first dive but assumes a multi-level dive instead of the repetitive dive just finished in example 3. After following examples 1–3, it can be seen that after a one hour surface interval the diver re-entering the water is a B diver. So dial B into the pressure group window. It is now ready to begin the multi-level dive.

The letter B should now appear in the pressure group window. Select a depth for the first portion of the multi-level dive. Again, always, make the deepest portion of the dive first.

This dive will begin at 80 feet. Subtract the residual nitrogen located below the selected depth from the no decompression limit which is located above it. This will give the new, no decompression limit. Again, the diver should always dive with this limit.

The new, no decompression limit is 22 minutes (30−8=22). Select a bottom time which will fall within this new decompression limit, and dial it in, by adding it to the residual nitrogen left over from the first dive.

The second dive will be to 80 feet for 10 minutes. Your ending pressure group will now be displayed in the pressure group window.

80 feet for 10 minutes means the diver is now an I diver. Select the depth for the second portion of the multi-level dive.

EXAMPLE 5

For the second portion of the dive, the diver wants to ascend to 60 feet. Subtract the residual nitrogen located below the selected depth from the no decompression limit which is located above it. This will give the new, no decompression limit. Again, always dive within this limit.

Your new, no decompression limit is 30 minutes (55−25=30). Select a bottom time which will fall within this new no decompression limit, and dial it in, by adding it to the residual nitrogen left over from the first level.

Level two will be at 60 feet for 15 minutes. 15+25=40 minutes. 40 is not listed on the scale, so you have to go up to 42. The current pressure group will now be displayed in the pressure group window.

60 feet for 15 minutes means the diver is now a Q diver. Select the depth for the third portion of the multi-level dive.

For the third portion of the dive, you want to ascend 40 feet. Subtract the residual nitrogen located below the selected depth from the no decompression limit which is located above it. This will give the new, no decompression limit.

The new, no decompression limit is 66 minutes. (140−74=66) Select a bottom time which will fall within this new no decompression limit, and dial it in, by adding it to the residual nitrogen left over from the second level.

Level three will be at 40 feet for 20 minutes (74+20=94). 94 is not listed on the scale, so you have to go up to 97. Your ending pressure group will now be displayed in the pressure group window. For a multi-level dive, this is all that needs to be done.

What is claimed is:

1. A device for calculating repetitive dive times for non-decompression dives, comprising:

a. a means for alignment for aligning charts, the charts including a pressure group chart including pressure groups, a residual nitrogen chart including integrated bottom times, and a surface interval chart including surface intervals, the residual nitrogen chart, the pressure group chart, and the surface interval chart in essentially parallel alignment;

b. a window means, slidably connected to the means for alignment, the window means including a maximum decompression time limit scale, a depth scale and a new pressure group scale including new pressure groups in essentially parallel alignment with each other and in essentially perpendicular alignment with the pressure group chart positioned on said means for alignment the window means for determining and displaying one of the pressure groups corresponding to a diving depth and corresponding to one of the integrated bottom times aligned by the means for alignment, and the window means for determining and displaying a set of the surface intervals corresponding to the one of the integrated bottom times, and for determining and displaying one of the new pressure groups corresponding to a selected surface interval of the set of surface intervals for a subsequent dive.

2. The device of claim 1, wherein the residual nitrogen chart further includes residual nitrogen information by virtue of the relationship between the residual nitrogen information and the integrated bottom times.

3. The device of claim 2, wherein the window means further comprises a surface interval alignment means for alignment of the integrated bottom times with a corresponding depth of the depth scale by virtue of the relationship of the pressure groups to the surface intervals.

4. The device of claim 2, wherein the window means is further defined as a sliding window selectively displaying the integrated bottom times and the surface intervals aligned with corresponding depths of the depth scale in essentially parallel alignment.

5. The device of claim 4, wherein the window means further comprises a window having a frame and wherein the window displays integrated bottom times aligned with the corresponding depths of the depth scale displayed on the window frame.

6. The device of claim 5, wherein the window means is further defined as displaying the surface interval chart in essentially parallel alignment with the integrated bottom times and visible through said sliding window and wherein the pressure groups corresponding with the integrated bottom times are displayed on the window frame.

7. The device of claim 6, wherein the device further comprises a direction restricting means for preventing the movement of the sliding window except in one direction.

8. The device of claim 7 wherein the direction restricting means comprises a plurality of steps mounted onto the alignment means said steps having a low side and a high side, the high side being in the direction of travel of the window means relative to the low side and wherein the restricting means further comprises a yieldable stop mounted on the window means so as to intercept and yieldably contact the steps as the window means moves relative to the alignment means.

9. The device of claim 6, wherein the means for alignment is mounted on a first cylinder and the window means comprises a second cylinder having a larger inner diameter than an outer diameter of the first cylinder.

10. The device of claim 1, wherein the window means displays at least one line of information including pressure groups with corresponding integrated bottom times and surface intervals.

* * * * *